US008433231B2

(12) United States Patent
Tanaka et al.

(10) Patent No.: US 8,433,231 B2
(45) Date of Patent: Apr. 30, 2013

(54) LASER FIXING DEVICE AND IMAGE FORMING APPARATUS INCLUDING THE LASER FIXING DEVICE

(75) Inventors: Atsushi Tanaka, Osaka (JP); Tetsunori Mitsuoka, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 282 days.

(21) Appl. No.: 12/942,329

(22) Filed: Nov. 9, 2010

(65) Prior Publication Data

US 2011/0116851 A1 May 19, 2011

(30) Foreign Application Priority Data

Nov. 16, 2009 (JP) ..... 2009-260784

(51) Int. Cl.
*G03G 15/20* (2006.01)

(52) U.S. Cl.
USPC ..... 399/336

(58) Field of Classification Search ..... 399/336
See application file for complete search history.

(56) References Cited

FOREIGN PATENT DOCUMENTS

| | | |
|---|---|---|
| JP | 59-095576 | 6/1984 |
| JP | 61-118780 | 6/1986 |
| JP | 07-191560 | 7/1995 |
| JP | 3016685 A | 12/1999 |
| JP | 2000-263845 | 9/2000 |
| JP | 2003-173029 | 6/2003 |
| JP | 2008-294134 | 12/2008 |

*Primary Examiner* — Walter L Lindsay, Jr.
*Assistant Examiner* — Barnabas Fekete
(74) *Attorney, Agent, or Firm* — Nixon & Vanderhye P.C.

(57) ABSTRACT

A defective laser element detector gives a fault detection of every laser element in each laser array. A controller determines whether the fault can be compensated for by the other laser elements, taking into account the arrangement, variation and other factors of available laser elements. If it is determined that the fault can be compensated, the controller increases the power of other laser elements individually based on comprehensive evaluation from the parameters such as irradiation areas, amounts of irradiation, irradiation timing and the like of the other adjacent laser elements in the same array including the fault and in the other arrays, so as to compensate the area of irradiation to be irradiated by the defective laser element as a whole.

7 Claims, 7 Drawing Sheets

LASER FIXING DEVICE AND IMAGE FORMING APPARATUS INCLUDING THE LASER FIXING DEVICE

This Nonprovisional application claims priority under 35 U.S.C. §119 (a) on Patent Application No. 2009-260784 filed in Japan on 16 Nov. 2009, the entire contents of which are hereby incorporated by reference.

BACKGROUND AND SUMMARY (1) Technical Field

The technology presented herein relates to a laser fixing device for use in an image forming apparatus based on electrophotography and an image forming apparatus including this laser fixing device.

(2) Description of the Prior Art

As fixing devices used for image forming apparatuses based on electrophotography such as copiers, printers, etc., fixing devices of heat roller fixing types are often used. A fixing device of a heat roller fixing type includes a pair of rollers (fixing roller and pressing roller) being pressed to each other, and is configured such that one or each of these rollers incorporates a halogen heater etc. so as to heat the pair of rollers to a predetermined temperature (fixing temperature) and a recording sheet with an unfixed toner image formed thereon is fed to and passed through the pressing contact (fixing nip portion), whereby the toner image is fixed with heat and pressure.

However, in the conventional heat roller type fixing device of this kind, it takes a long warm-up time to raise the temperature of the fixing roller and pressing roller to the predetermined fixing temperature, so that it is necessary to pre-heat the fixing roller and pressing roller also in the standby mode, hence posing the problem of power consumption being increased.

In order to solve this problem, a laser type fixing device that performs a fixing process by irradiating the unfixed toner image formed on the recording paper with laser beams emitted from laser elements arranged in a row to fuse and fix the toner image has been proposed in Patent Document 1 (Japanese Patent No. 3016685) and others. However, this method has the problem that if some of laser elements have broken down, there occur areas where a sufficient amount of irradiation with laser beams for fixing cannot be obtained.

To deal with this, Patent Document 2 (Japanese Patent Application Laid-open H07-191560) discloses a technology in which laser beams from multiple laser emitters are radiated on one area of the recording paper in an overlapping manner so as not to cause any unfixed area even if some laser elements have broken down.

However, even if laser beams from multiple laser emitters are arranged so as to irradiate in an overlapping manner and compensate for the reduction of the amount of irradiation by the neighboring laser elements if a laser element has broken down, there is a possibility to cause partial fixing failure and/or gloss unevenness due to difference in intensity of irradiated energy when a large amount of toner is supplied and adhered, for example, in a multi-layered color image.

The present technology has been devised in view of the above conventional problems, it is therefore a feature of the present technology to provide a laser fixing device that can provide a stable performance in toner fixing even when some laser elements have broken down as well as providing an image forming apparatus including this laser fixing device.

The example embodiment presented herein resides in a laser fixing device for fusing and fixing a toner image formed on a recording medium, to the recording medium by irradiating the toner image with laser light, comprising: a laser array module having a plurality of laser elements arrayed therein; a defective laser element detector for detecting a defective laser element; and, a controller which, when a defective laser element is detected by defective laser element detector, increases the power of laser elements that can radiate laser light on areas overlapping with the area of irradiation of the defective laser element in order to compensate for reduction in irradiation intensity in that area.

In the above way, the loss of irradiation intensity due to the broken laser element is compensated by the neighboring laser elements so as to enable uniform laser irradiation, making it possible to alleviate local fixing failure and gloss unevenness.

The laser fixing device is further characterized in that the controller sets up compensating conditions for the laser elements to be increased in power, in accordance with the area to be irradiated, the amount of irradiation and the timing for irradiation.

In this way, since the optimal compensation conditions are set up in accordance with the area of irradiation, the amount of irradiation that can be compensated and the irradiation timing, it is possible to constantly provide stable fixing performance.

The laser fixing device is further characterized in that the controller selectively uses laser elements to be increased in power, depending on the degree of degradation of the irradiating intensity of the defective laser element.

In this way, since the laser elements to be used for compensation are selected depending on the degree of degradation of the defective laser element, this makes it possible to markedly alleviate the shortening of the life of the normal laser elements.

The laser fixing device is further characterized in that when having determined that the defective laser element cannot be compensated for by other laser elements, the controller limits the recording mediums to the size at which the defective laser element will not be involved in fixing.

In this way, even when compensation by laser irradiation from those other than the defective laser element is impossible, the functions to be suspended can be minimized so as to keep user's loss of convenience to a minimum.

The laser fixing device is further characterized in that when having determined that the defective laser element cannot be compensated for by other laser elements, the controller switches the conveying speed of recording mediums to a lower speed so as to acquire the necessary amount of irradiation for compensation.

In this way, even when compensation by laser irradiation from those other than the defective laser element is impossible, it is possible to keep user's loss of convenience to a minimum by enabling a fixing process, though the conveying speed of the recording paper is lowered.

The laser fixing device is further characterized in that the laser array module is formed of one or more arrays arranged in the conveying direction of recording mediums, each having a row of laser elements arranged in the perpendicular direction to the conveying direction, and the compensating controller uses the laser elements, of the array to which the defective laser element belongs and, of the other arrays.

In this way, the burden for compensation is shared by a number of normal laser elements so that it is possible to reduce the burden on individual laser elements. Accordingly, it is possible to obtain preferable performance without notable loss of the life of the laser elements.

The laser fixing device is further characterized in that the defective laser element detector performs fault decision when no job operation is performed.

The present embodiment resides in an image forming apparatus comprising: a photoreceptor drum having the surface on which an electrostatic latent image is formed by irradiation with light; a light exposure unit that irradiates the photoreceptor drum with the light to form the electrostatic latent image; a developing unit that supplies toner to the electrostatic latent image on the photoreceptor drum surface to form a toner image; a transfer device for transferring the toner image from the photoreceptor drum surface to a recording medium; and, a fixing device for fixing the transferred toner image to the recording medium, wherein the fixing device employs the laser fixing device described above.

According to the present embodiment, the loss of irradiation intensity due to the broken laser element is compensated by other laser elements so as to enable uniform laser irradiation, making it possible to alleviate local fixing failure and gloss unevenness. Further, even when compensation by laser irradiation from those other than the defective laser element is impossible, it is possible to continue a fixing process though it is conditional, hence keep user's loss of convenience to a minimum.

DESCRIPTION OF THE PREFERRED EMBODIMENTS

The embodiment of the present invention will hereinafter be described with reference to the accompanying drawings.

Figure 1:
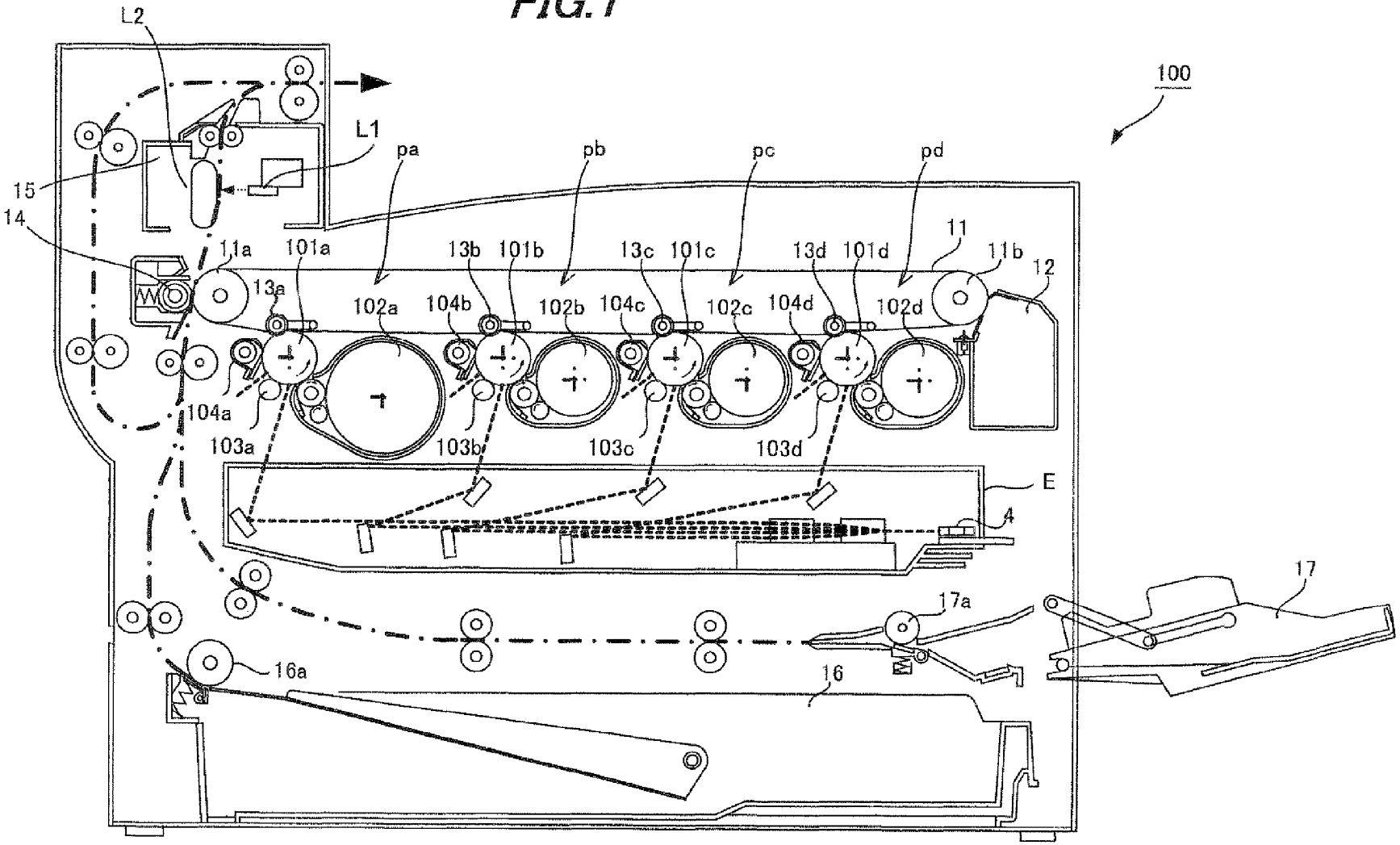
FIG. 1 is a diagram showing a schematic configuration of a color multi-functional machine including a laser fixing device according to an example embodiment.
Figure 2:
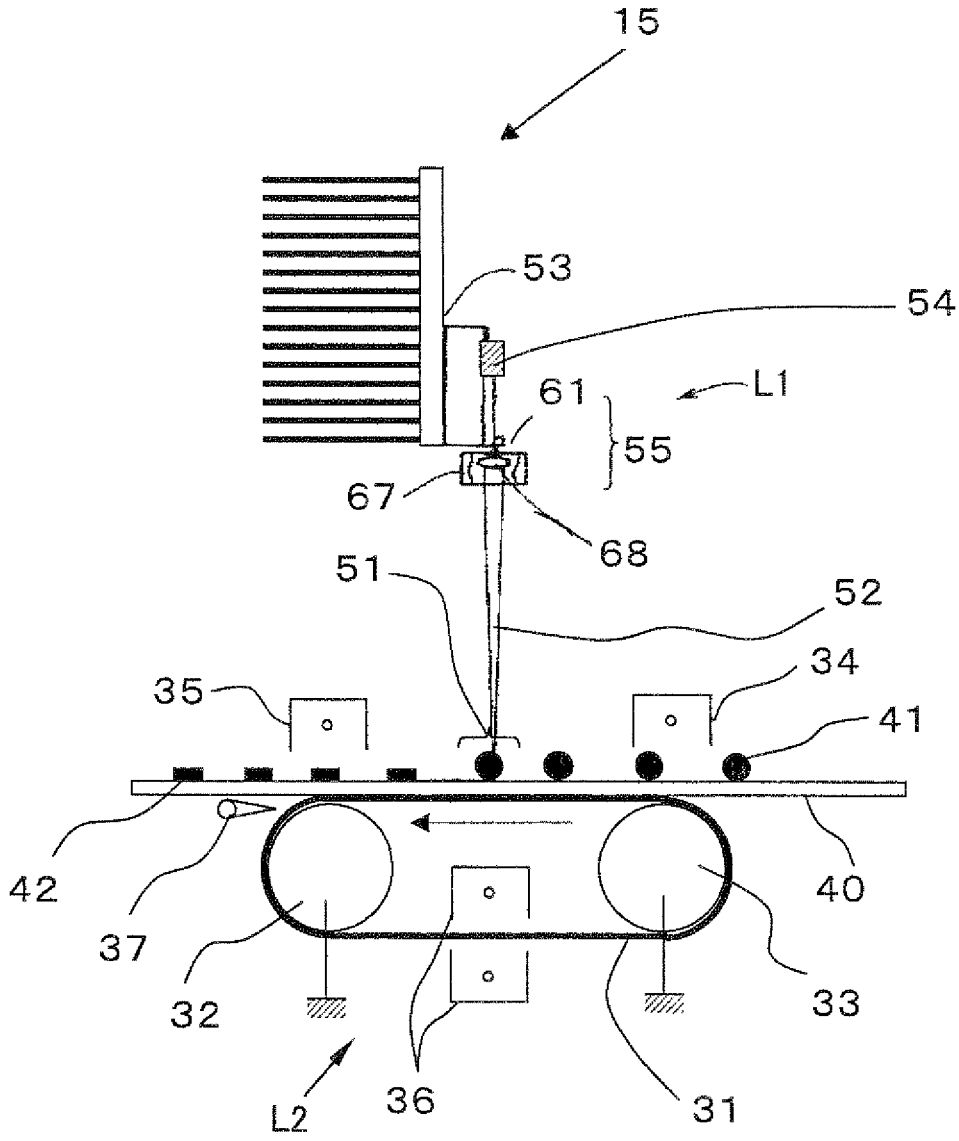
FIG. 2 is a sectional diagram showing a configuration of a laser fixing device including a single laser array.
Figure 3:
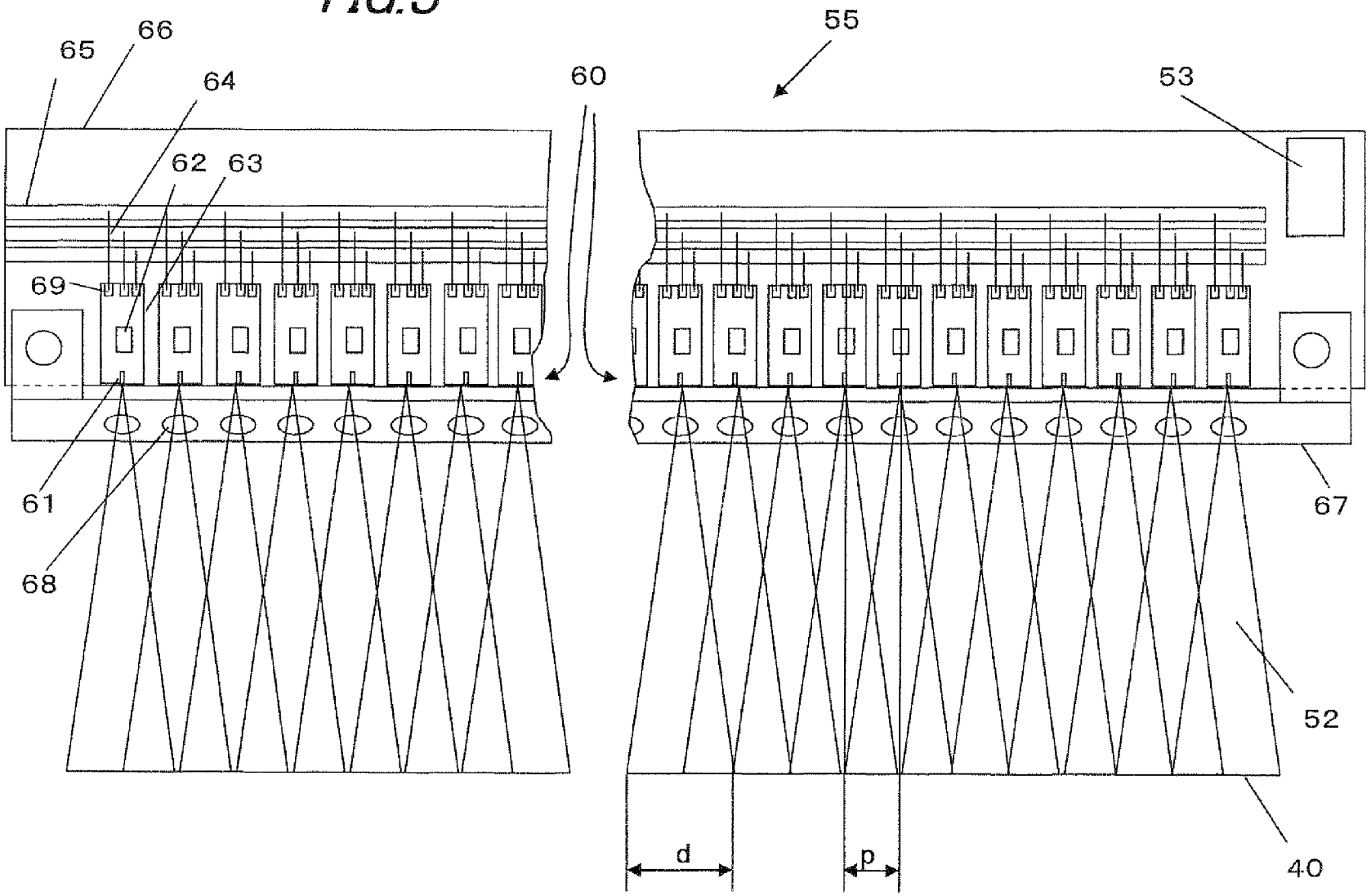
FIG. 3 is an illustrative diagram showing a configuration of a laser head viewed from the front.
Figure 4:
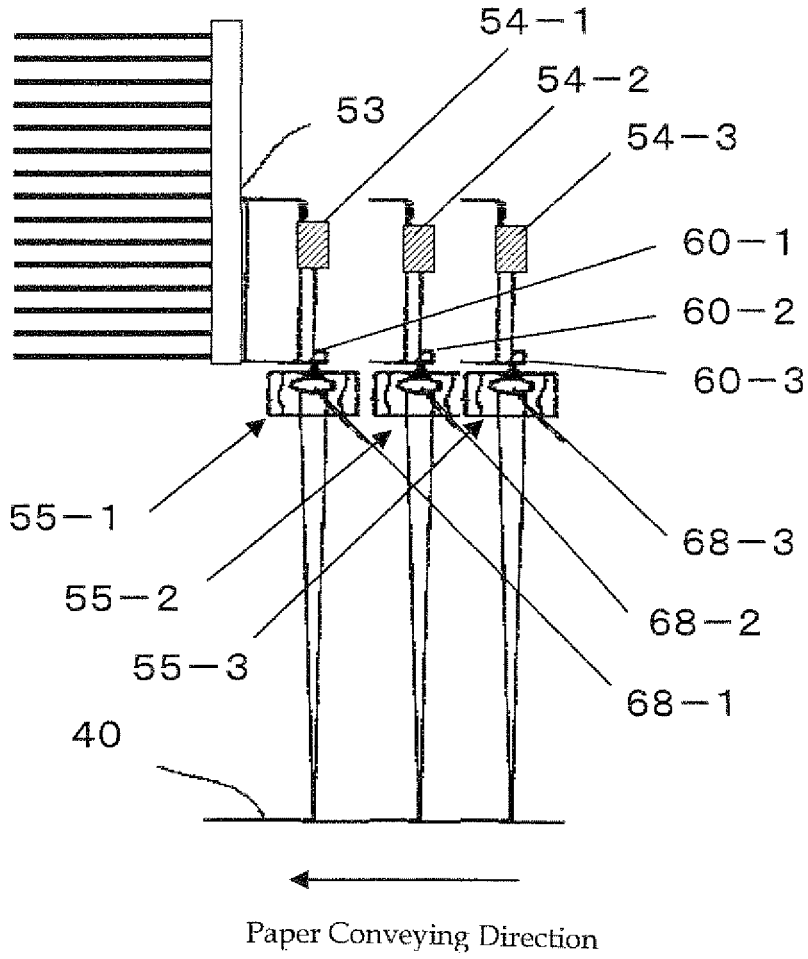
FIG. 4 is a sectional diagram showing a configuration of a laser fixing device including a plurality of laser arrays.

One embodied mode of the present embodiment will be described with reference to FIGS. 1 to 4. The present embodiment is a case where an image forming apparatus of the present invention is applied to a color multi-functional machine. FIG. 1 is a diagram showing a schematic configuration of a color multi-functional machine, FIG. 2 is a sectional diagram showing a configuration of a laser fixing device including a single laser array, FIG. 3 is an illustrative diagram showing a configuration of a laser head viewed from the front, and FIG. 4 is a sectional diagram showing a configuration of a laser fixing device including a plurality of laser arrays.

As shown in FIG. 1, a color multi-functional machine 100 according to the present embodiment includes an optical unit E, four sets of visual image forming units pa, pb, pc and pd, an intermediate transfer belt 11, a secondary transfer unit 14, a fixing unit (laser fixing device) 15, an internal paper feed unit 16 and a manual paper feed unit 17.

Visual image forming unit pa has a charger unit 103*a*, a developing unit 102*a* and a cleaning unit 104*a* arranged around a photoreceptor 101*a* to be a toner image bearer. A primary transfer unit 13*a* is arranged on the opposite side across intermediate transfer belt 11 from photoreceptor 101*a*. The other three sets of visual image forming units pb, pc and pd have the same configuration as that of visual image forming unit pa. The developing units of individual visual image forming units hold respective color toners, namely, yellow (Y), magenta (M), cyan (C) and black (B) toners.

Optical unit E is arranged so that data from a light source 4 can reach four photoreceptors 101*a*, 101*b*, 101*c* and 101*d*. Intermediate transfer belt 11 is wound without slack between tension rollers 11*a* and 11*b* with a waste toner box 12 and a secondary transfer unit 14 abutted against the belt on the tension roller 11*b* side and on the tension roller 11*a* side, respectively. Fixing unit 15 is composed of a laser head L1 and a paper conveying mechanism L2 and arranged on the downstream side of secondary transfer unit 14 with respect to the paper conveying direction.

The image forming process is carried out as follows.

The photoreceptor drum 101*a* surface is uniformly electrified by charger unit 103*a*, then subjected to laser exposure based on image information by optical unit E to form an electrostatic latent image on the photoreceptor drum 101*a* surface. As charger unit 103*a*, an electrostatic roller mechanism is adopted in order to charge the photoreceptor drum 101.*a* surface uniformly whilst inhibiting generation of ozone gas as much as possible. Then, the electrostatic latent image on the photoreceptor drum 101*a* is developed into a toner image by developing unit 102*a*. The thus visualized toner image is once transferred to intermediate transfer belt 11 by means of transfer unit 13*a* to which a bias voltage of the opposite polarity to that of the toner is applied. The other three visual image forming units pb, pc and pd also operate in the same manner to successively transfer individual toner images to intermediate transfer belt 11. The toner image on intermediate transfer belt 11 is conveyed to secondary transfer unit 14 and transferred to the recording paper (sheet) fed from internal paper feed unit 16 by a paper feed roller 16*a* or from manual paper feed unit 17 by a paper feed roller 17*a*, under application of a bias voltage of the opposite polarity to that of the toner. The toner image on the recording paper is conveyed to fixing unit 15 and heated and fused to the recording paper by laser irradiation, and then the recording paper is discharged outside.

Next, the laser fixing device of the present embodiment will be described in detail with reference to FIGS. 2 to 4.

FIG. 2 shows a basic structure of the laser fixing device. As shown in FIG. 2, laser fixing device (fixing unit) 15 includes a laser head (laser emitter) L1 and a paper conveying mechanism (paper conveyor) L2.

Laser fixing device 15 of the present embodiment fixes an unfixed toner image 41 formed on the surface of recording paper 40 as a recording medium by heat. Specifically, recording paper 40 supporting unfixed toner image 41 is conveyed through a laser irradiated station 51 on paper conveying mechanism L2 at which laser light 52 is radiated, at a predetermined fixing speed and copying speed, so that the toner is fixed by heat from laser light 52 (fixed toner 42). In the image forming apparatus of the present embodiment, the maximum fixing speed is specified at 225 mm/sec., and the maximum copying speed at 50 sheets/min (A4 short edge feed), and the aftermentioned fixing speed (copy speed) is variably controlled in accordance with the image pattern.

Unfixed toner image 41 is formed of toner included in the developer such as, for example a non-magnetic mono component developer containing non-magnetic toner, non-magnetic dual component developer containing non-magnetic toner and a carrier, or magnetic developer containing magnetic toner. Since the color toners (yellow, magenta and cyan) are low in absorption ratio of laser light 52 compared to the monochrome toner, an infrared absorbent is added (for example, 1 to 5 parts by weight of phthalocyanine as an infrared absorbent are internally added to 100 parts by weight of the main binder resin of the color toner; other than phthalocyanine, polymethine, cyanine, onium, nickel complex, etc. can be used instead or in combination) to thereby secure the equivalent absorption ratio to that of the monochrome toner.

Paper conveying mechanism L2 includes a conveyor belt 31, drive roller 32, driven roller 33, attraction charger 34, separation charger 34, charge erasing charger 36, separation claws 37 and a drive motor (not shown).

Conveyor belt 31 is formed of a polyimide resin having a belt thickness of 75 μm and a volume resistivity of $10^{16}$ Ω·cm, and is supported and tensioned between drive roller 32 and driven roller 33.

Drive roller 32 is adapted to rotate at an arbitrary rate by the drive motor (not shown) while conveyor belt 31 is circulatively driven at an arbitrary speed in the direction of the arrow by the rotational drive of drive roller 32.

Further, attraction charger 34, separation charger 35, charge erasing charger 36 and separation claws 37 are arranged around conveyor belt 31.

In this paper conveying mechanism L2, recording paper 40 with unfixed toner image 41 formed thereon that has been conveyed from secondary transfer unit 14, is fed through between conveyor belt 31 over driven roller 33 and attraction charger 34.

Driven roller 33 is formed of a conductive material and grounded, and supplying electricity from attraction charger 34 to paper 40 causes dielectric polarization in each of recording paper 40 and conveyor belt 31 so that recording paper 40 is electrostatically attracted to conveyor belt 31.

Recording paper 40 is conveyed by the drive of drive roller 32 to laser irradiated station 51.

Unfixed toner image 41 on recording paper 40 that has been conveyed up to laser irradiated station 51 is irradiated with laser from laser head L1 in accordance with image information so as to fix the toner (fixed toner 42).

Recording paper 40 with the toner image having been fixed at laser irradiated station 51 is kept electrostatically attracted to conveyor belt 31 and conveyed into a gap between separation charger 35 and drive roller 32.

Drive roller 32 is formed of a conductive material, and grounded, so that erasure of electricity from the recording paper 40 surface by means of separation charger 35 weakens electrostatic attracting force between conveyor belt 31 and recording paper 40. Conveyor belt 31 moves along drive roller 32 under this condition. Since drive roller 32 has a large curvature at this point, the front end of recording paper 40 departs from conveyor belt 31 and then the recording paper 40 is completely separated from conveyor belt 31 by means of separation claws 37.

Conveyor belt 31 after separation of recording paper 40 is cleared of the electricity on the interior and exterior surfaces by means of charge erasing charger 36, and driven once again to the attracting position of recording paper 40.

Laser head L1 irradiates unfixed toner image 41 with laser light 52 at laser irradiated station 51 to fix the toner onto recording paper 40.

As shown in FIGS. 2 and 3, laser head L1 includes a laser emitter 55, a radiating plate (heat sink) 53 and a temperature sensor 54.

Laser emitter 55 includes a semiconductor laser array 60 (FIG. 3) having a row of multiple semiconductor laser elements 61 arranged perpendicularly (across the width of conveyor belt 31) to the conveying direction of recording paper 40 (which may be referred to hereinbelow as "paper conveying direction").

Here, the present embodiment uses a semiconductor laser array 60 of 1,000 laser elements 61, each having a rated output power of 150 mW at a wavelength of 780 nm. These laser elements 61 are arranged with a pitch P of 0.3 mm and have a laser spot diameter of 0.6 mm so that the area of irradiation of each laser element 61 overlaps those of the adjacent ones.

Heat sink 53 used here is formed by arraying 10 heat sinks (UB30-20B, a product of Alpha Company Ltd.) of an aluminum alloy, each having a base size of 30 mm×30 mm and a height of 20 mm, having a thermal impedance of 1.6 deg. C./W) (total thermal impedance: 0.16 deg. C./W).

Further, the detailed structure of laser head. L1 will be described with reference to FIGS. 3 and 4.

As shown in FIG. 3, in laser emitter 55 of laser head L1, each semiconductor laser element (chip) 61 is mounted on a silicon substrate 63 on which a control circuit 83 (FIG. 5) for variably controlling the laser light power based, on the input signal or keeping the laser power constant based on the signal from a monitoring photo diode 62 as a light receiving element and photodiode 62, are monolithically formed, and the laser element 61 and silicon substrate 63 are electrically connected by wire-bonding or the like.

Next, a multiple number of silicon substrates 63 with a laser element mounted thereon, are attached onto a ceramic board 66, and electrodes 69 on silicon substrate 63 are electrically connected to associated surface electrodes 65 of ceramic board 66, by wire bonding lines 64 and the like.

Finally, radiating plate 53 and a lens holder 67 holding a plurality of convex lenses 68 as multiple sets of condensing optical systems are mounted to ceramic board 66 on which multiple laser elements 61 are arrayed. In this way, laser head L1 according to the present embodiment is manufactured.

As the structure for multiple convex lenses 68 and lens holder 67 in this laser emitter L1, use of a lens-lens holder of an integral resin molding and use of a flat micro-lens array produced by shaping a flat glass plate into a lenticular surface by performing ion exchange have advantages in cost, fabrication and assembly precision compared to the configuration in which individual convex lenses 68 are assembled in a resin holder etc.

It is also possible to radiate laser beams without using any condensing optical system, i.e., as they remains parallel beams, on the toner image.

Attached further on ceramic board 66 is a temperature sensor 54 (FIGS. 2 and 4) made of thermistor in order to measure the temperature of laser head L1. Here, this thermistor 54 is positioned at the center with respect to the longitudinal direction of fixing device 15 (the width direction of conveyor belt 31).

FIG. 4 shows laser head L1 in the laser fixing device of the present embodiment. This laser head has multiple laser emitters 55-1, 55-2 and 55-3 and multiple temperature sensors 54-1, 54-2 and 54-3 arranged at intervals of a predetermined distance in the paper conveying direction.

Laser emitters 55-1, 55-2 and 55-3 include laser arrays 60-1, 60-2 and 60-3 and lenses 68-1, 68-2 and 68-3, and others, respectively.

Recording paper 40 is conveyed in the direction of the arrow in FIG. 4 so that the toner on the recording paper is successively irradiated by laser by laser arrays 60-3, 60-2 and 60-1 in the order mentioned. At this point, laser fixing device 15 controls the voltage to be applied to each laser element 61 based on the temperature data on laser irradiated station 51, detected by thermistor (temperature sensor) 54.

Laser fixing device 15 further includes a defective laser element detector 82 (FIG. 5) so as to make fault detection of laser element 61.

The method of locating a fault is performed by monitoring the level of the current flowing through each laser element 61 and to determine a defective one if the current level exceeds a fixed threshold.

When a defective laser element 61 is detected, laser fixing device 15 controls the laser elements 61 that operate normally and the paper conveying mechanism in order to compensate for the loss of laser irradiation.

Figure 5:
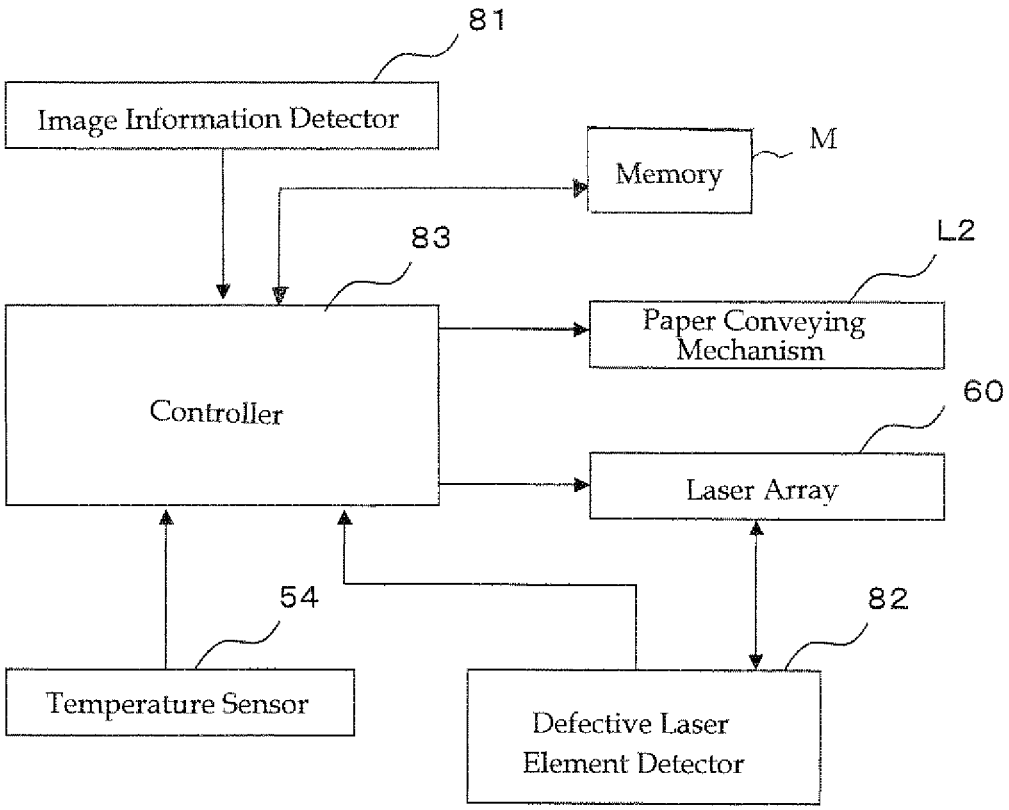
FIG. 5 is a block diagram showing a laser fixing device.

FIG. 5 is a block diagram of the laser fixing device that makes this compensation for laser irradiation.

Laser fixing device 15 includes an image information detector 81 for detecting image information formed on the recording paper, paper conveying mechanism L2, laser array 60 formed of laser elements 61 that emit laser light, temperature sensor 54, defective laser element detector 82, memory M and controller 83.

Next, compensation control to be made when a laser element has broken down for an unknown reason will be described with reference to FIGS. 6 and 7.

Figure 6:
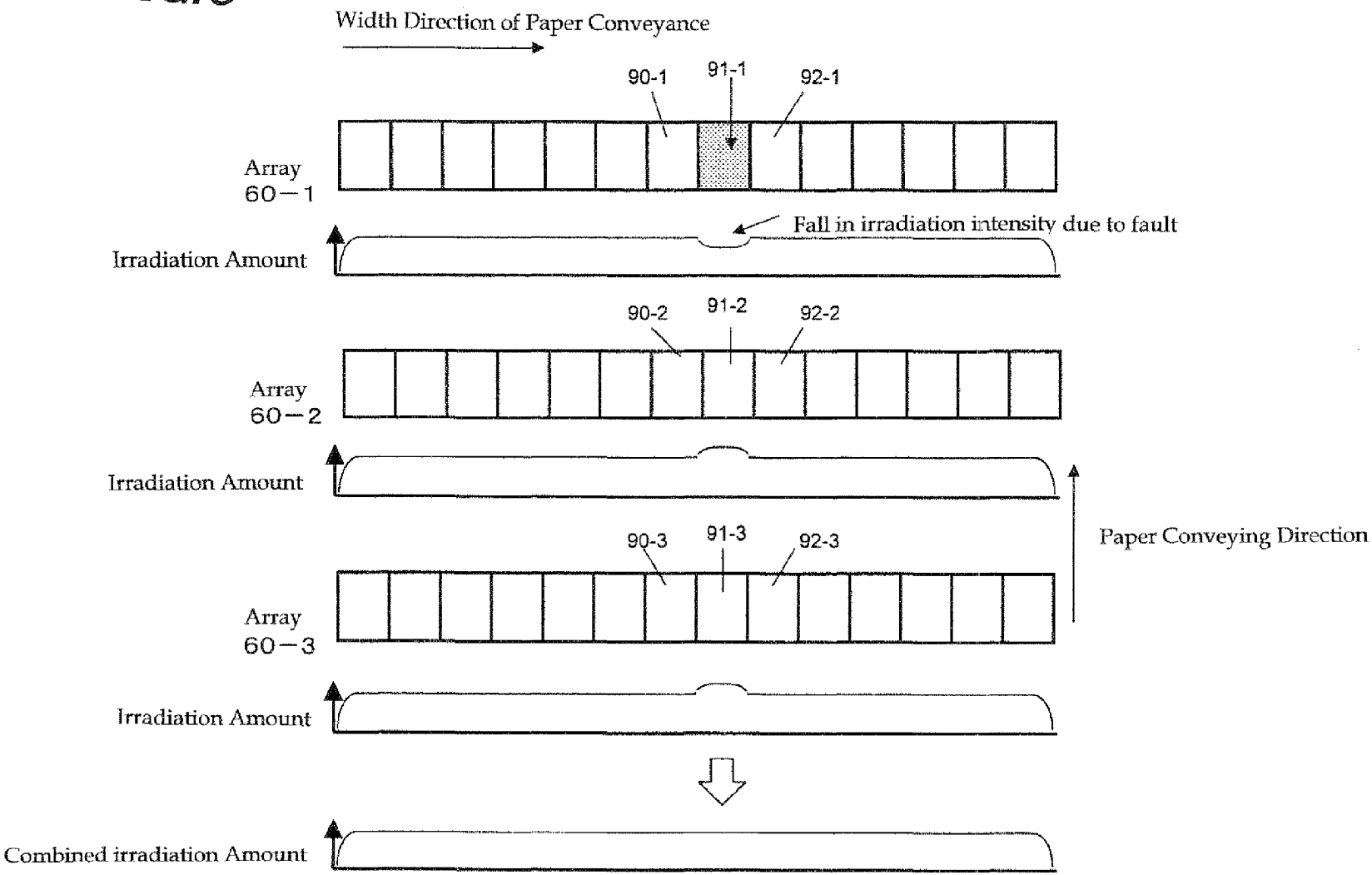
FIG. 6 is an illustrative diagram showing laser arrays including a defective laser element and the amount of irradiation; and, FIG. 7 is a flow chart showing the operational sequence of compensation control in the laser fixing device when there is a defective laser element.
Figure 7:
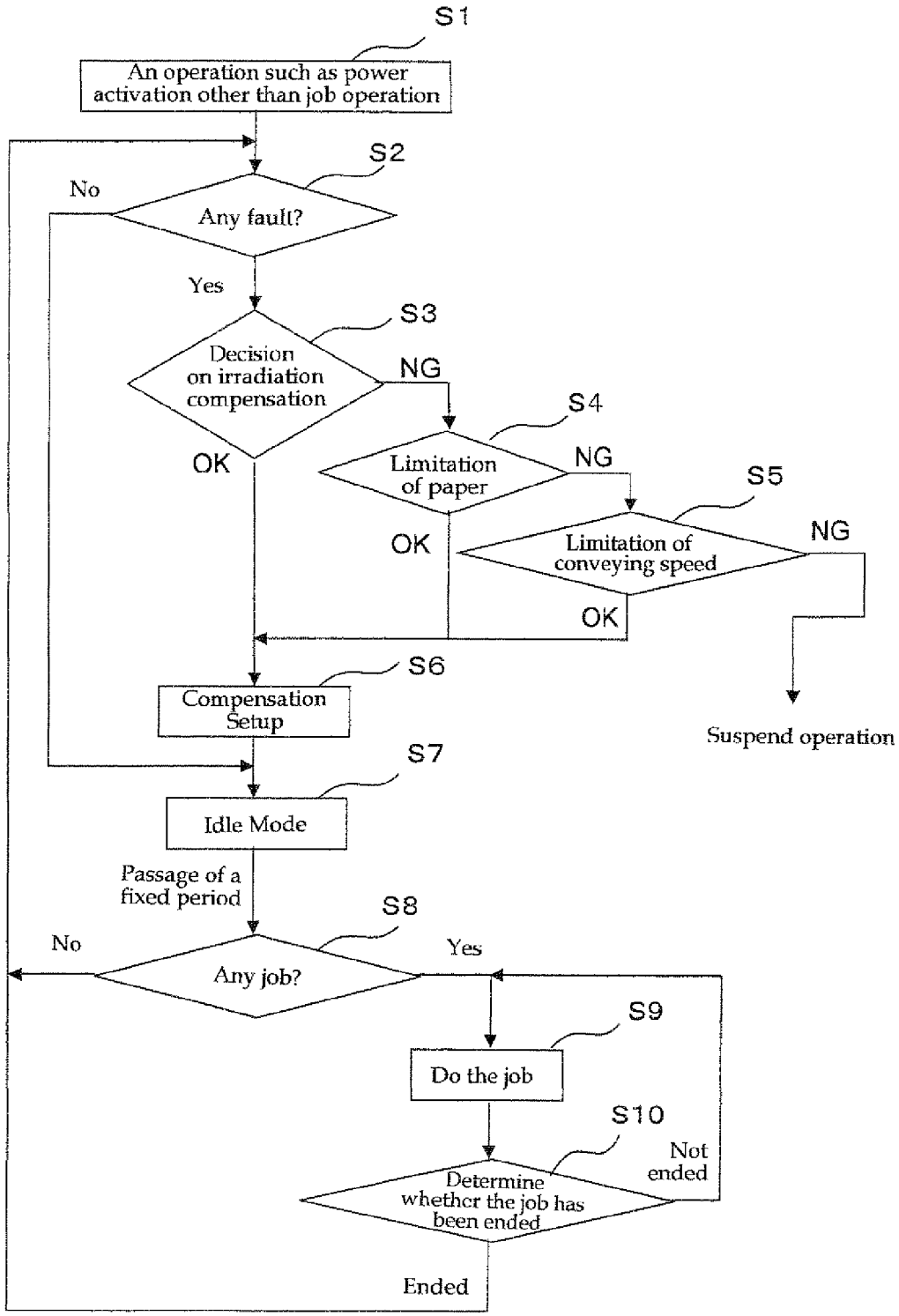

FIG. 6 is an illustrative diagram showing laser arrays including a defective laser element and the amount of irradiation, and FIG. 7 is a flow chart showing the operational sequence of compensation control in the laser fixing device when there is a defective laser element.

To begin with, when the power to image forming apparatus 100 is turned on (Step S1), defective laser element detector 82 (FIG. 5) performs fault detection of laser elements 61 of each laser array 60 (Step S2).

As the method of fault detection, the current level to each laser element 61 is monitored, and if the level exceeds a fixed threshold, the laser element is determined to be defective.

The operation of detecting defective laser elements 61 is performed at warm-up, idling and modes other than job operation, as well as at the initial operation after power activation of image forming apparatus 100.

Controller 83 (FIG. 5) records the located defective laser element in memory M and determines whether the fault can be compensated for by the other elements, taking into account the arrangement, variation and other factors of available laser elements 61 (Step S3).

When it is determined at Step S3 that the fault can be compensated, controller 83 increases the power of other laser elements individually based on comprehensive evaluation from the parameters such as irradiation areas, amounts of irradiation, irradiation timing and the like of the other adjacent laser elements in the same array that includes the fault and in the other arrays, so as to set up an overall scheme of compensation for the area that would be irradiated by the defective laser element and store the scheme into memory M (Step S6). In this process, it is possible to reduce the burden on the individual laser elements and make compensation without markedly spoiling the life of normal laser elements, by making the number of the laser elements that contribute to compensation as many as possible.

For example, as shown in FIG. 6, suppose that one defective laser element 91-1 in laser array 60-1 is detected by defective laser element detector 82. Controller 83 increases the power of the laser elements in laser arrays 60-2 and 60-3 at the position corresponding to that of broken laser element 91-1 of laser array 60-1 and the laser elements on both sides of them respectively.

Specifically, since the laser arrays are arranged in the order of 60-3, 60-2 and 60-1 with respect to the paper conveying direction, the laser elements 91-2 and 91-3 in laser arrays 60-2 and 60-3 that irradiate the same position, with respect to the width of conveyor belt 31 that is perpendicular to the paper conveying direction, as defective laser element 91-1 of laser array 60-1 would irradiate, are selected as the compensative laser elements. Further, the laser elements located on both sides of them, 90-2, 92-2, 90-3 and 92-3 are also selected as the compensative laser elements. This is because the areas irradiated, with laser light from compensative laser elements 90-2, 92-2, 90-3 and 92-3 overlap the area of irradiation from the defective laser element.

Controller 83 increases the laser power of compensative laser elements 90-2 to 92-2 and 90-3 to 92-3 in accordance with the determined compensation setup. In this process, in order to make the life of the compensative laser elements as long as possible, controller 83 selects the laser elements to be used, from the compensative laser elements and sets up the area of irradiation, amount of irradiation and irradiation timing, in accordance with the degree of degradation of the irradiation intensity level of the defective laser element 91-1.

In this way, as shown in FIG. 6, the irradiated intensity reduction at the position in laser array 60-1 is compensated so that the total amount of combined irradiation can be made normal and a stable fixing process can be achieved. Further, it is also possible to inhibit the life of laser elements from being shortened due to increase of the power of the multiple laser elements.

Here, laser elements 90-1 and 92-1 in laser array 60-1 may also be used as the compensative laser. When a lens array (laser array 60-1 only) is used alone as shown in FIG. 2, laser elements 90-1 and 92-1 can be used to compensate for reduction in irradiation intensity of defective laser 91-1.

In this way, controller 83 determines whether irradiation compensation is possible by taking into account the number of defective elements, the distribution, areas of irradiation, irradiation amounts and irradiation timing of elements and other factors, comprehensively.

The description above is the case that can be compensated for. For example, when a plurality of laser elements located contiguously are broken so that irradiation compensation is impossible (Step S3; NG), controller 83 determines whether it is possible to execute the fixing process for the paper of sizes within which the range of irradiation of the defective laser elements will not fall (Step S4). More specifically, if the defective elements are located locally near the side edges, the controller only permits printing for recording paper of sizes that correspond to the width fixable by the normal laser elements alone.

In this way, even when compensation by laser irradiation from those other than the defective laser elements is impossible, the functions to be suspended can be minimized so as to keep user's loss of convenience to a minimum.

Even when compensation is impossible by limiting the recording paper size (Step S4; NG), controller 83 determines whether it is possible to secure a sufficient amount of irradiation by retarding the speed of conveyance of paper conveyor mechanism. L2 (Step S5). Specifically, when a sufficient amount of irradiation cannot be secured to compensate for a plurality of defective laser elements, an operation may be performed by lowering the overall intensity of laser irradiation to secure the necessary amount of irradiation for compensation and leveling out the amount of laser irradiation while the fixing performance that is lowered proportionally, is secured, by retarding the conveying speed of the recording paper to extend laser irradiating time.

In this way, even when compensation by laser irradiation from those other than the defective laser element is impossible, it is possible to keep user's loss of convenience to a minimum by enabling a fixing process though the conveying speed of recording paper is lowered.

When it is still impossible to secure the necessary amount of irradiation by retarding the conveying speed (Step S5; NG), the operation is suspended.

If it is determined at the decision for compensation at Steps S3 to S4 that compensation is possible, controller 83 sets up the fixing condition that enables compensation, and records the condition into memory M (Step S6).

Then, the image forming apparatus is set in idle mode until any job instruction is given (Step S7).

Controller 83 determines whether there exists input of a job (Step S8). If there is a job (Step S8; Yes), the controller executes a job by performing a fixing process under the fixing condition set at Step S6 (Step S9).

That is, controller 83 acquires image information for performing the fixing process from image information detector 81 and causes laser array 60 to perform laser irradiation.

If there is no job, the control goes back to Step S2. Then, the controller determines whether the job has been completed (Step S10), and the control goes back to Step S2 if the job has been completed.

Use of this laser fixing device enables the laser elements around defective laser elements to compensate for reduction in irradiation intensity around the defective ones, enabling uniform laser irradiation, alleviation of local fixing failure and gloss unevenness and provision of stable image formation, even in color multi-functional machines and other image forming apparatuses.

What is claimed is:

1. A laser fixing device for fusing and fixing a toner image formed on a recording medium, to the recording medium by irradiating the toner image with laser light, comprising:

a laser array module having a plurality of laser elements arrayed therein;

a defective laser element detector for detecting a defective laser element; and, a controller which, when a defective laser element is detected by defective laser element detector, increases the power of laser elements that can radiate laser light on areas overlapping with the area of irradiation of the defective laser element in order to compensate for reduction in irradiation intensity in that area, wherein when having determined that the defective laser element detector cannot be compensated for by other laser elements, the controller limits the recording mediums to the size at which the defective laser element will not be involved in fixing.

2. The laser fixing device according to claim 1, wherein the controller sets up compensating conditions for the laser elements to be increased in power, in accordance with the area to be irradiated, the amount of irradiation and the timing for irradiation.

3. The laser fixing device according to claim 1, wherein the controller selectively uses laser elements to be increased in power, depending on the degree of degradation of the irradiating intensity of the defective laser element.

4. The laser fixing device according to claim 1, wherein when having determined that the defective laser element detector cannot be compensated for by other laser elements, the controller switches the conveying speed of recording mediums to a lower speed so as to acquire the necessary amount of irradiation for compensation.

5. The laser fixing device according to claim 1, wherein the laser array module is formed of one or more arrays arranged in the conveying direction of recording mediums, each having a row of laser elements arranged in the perpendicular direction to the conveying direction, and the controller uses the laser elements, of the array to which the defective laser element belongs and, of the other arrays.

6. The laser fixing device according to claim 1, wherein the defective laser element detector performs fault decision when no job operation is performed.

7. An image forming apparatus comprising:

a photoreceptor drum having the surface on which an electrostatic latent image is formed by irradiation with light;

a light exposure unit that irradiates the photoreceptor drum with the light to form the electrostatic latent image;

a developing unit that supplies toner to the electrostatic latent image on the photoreceptor drum surface to form a toner image;

a transfer device for transferring the toner image from the photoreceptor drum surface to a recording medium; and, a fixing device for fixing the transferred toner image to the recording medium, characterized in that the fixing device employs the laser fixing device according to claim 1.

* * * * *